US005174096A

United States Patent [19]

Fukuda

[11] Patent Number: 5,174,096

[45] Date of Patent: Dec. 29, 1992

[54] FORM-FILL-SEAL TYPE PACKAGING MACHINE

[75] Inventor: Masao Fukuda, Shiga, Japan

[73] Assignee: Ishida Scales Mfg. Co., Ltd., Shiga, Japan

[21] Appl. No.: 770,087

[22] Filed: Oct. 1, 1991

[30] Foreign Application Priority Data

| | | | |
|---|---|---|---|
| Oct. 5, 1990 | [JP] | Japan | 2-268653 |
| Jul. 12, 1991 | [JP] | Japan | 3-198863 |
| Aug. 14, 1991 | [JP] | Japan | 3-204084 |

[51] Int. Cl.[5] ..... B65B 9/20; B65B 41/16

[52] U.S. Cl. ..... 53/551; 53/389.4; 226/19; 226/21; 226/199

[58] Field of Search ..... 53/551, 552, 550, 451, 53/546, 51, 389.2, 389.4; 226/19, 21, 197, 199; 242/72 R, 72.1, 58.6, 66.2, 54

[56] References Cited

U.S. PATENT DOCUMENTS

| | | | |
|---|---|---|---|
| 2,237,119 | 4/1941 | Smith | 53/546 X |
| 3,595,459 | 7/1971 | Colombo | 226/21 X |
| 3,679,116 | 7/1972 | Hamlin et al. | 226/19 X |
| 3,682,362 | 8/1972 | Ott, Jr. | 226/21 |
| 3,815,317 | 6/1974 | Toss | 53/451 |
| 3,989,202 | 11/1976 | Noé et al. | 242/72 R |
| 4,049,213 | 9/1977 | Hank et al. | 226/19 X |
| 4,081,943 | 4/1978 | Leasure et al. | 53/552 X |
| 4,142,690 | 3/1979 | Karle et al. | 242/72.1 X |
| 4,552,613 | 11/1985 | Auer | 53/551 X |
| 4,590,746 | 5/1986 | Humphrey | 53/389.4 X |
| 4,848,063 | 7/1989 | Niske | 53/451 |
| 4,863,087 | 9/1989 | Kohler | 226/19 X |
| 5,002,235 | 3/1991 | Greer et al. | 242/58.6 |
| 5,014,498 | 5/1991 | McMahon | 53/551 X |
| 5,027,584 | 7/1991 | McMahon et al. | 53/551 X |
| 5,040,359 | 8/1991 | Thimon | 53/389.4 X |
| 5,074,450 | 12/1991 | Lindner et al. | 226/21 |

*Primary Examiner*—Horace M. Culver

*Attorney, Agent, or Firm*—Heller, Ehrman, White & McAuliffe

[57] ABSTRACT

A form-fill-seal packaging machine, which pulls out an elongated film from a film roll and transports it to a former to form it in a tubular shape, includes a mechanism with two parallel rollers such that the film path can be shifted transversely. The two rollers are formed as two sides of a linked parallelogram unit, of which the shape is automatically changeable according to the direction of the rollers so as to reduce the transverse distance by which the film will have to slide on the rollers. According to another embodiment, the packaging machine has its film-supporting shaft extending in backward direction. A horizontal rod disposed diagonally to the path of the film causes it to turn by 90 degrees towards the former at a front part of the machine. This diagonal rod is adapted to move horizontally in the forward-backward direction, depending on the width of the film being transported such that the film is accurately directed to the former. A pair of such packaging machines, plane-symmetrically built with respect to each other, can be used advantageously in combination with a weigher having two discharge chutes because of the reduced separation between their formers.

10 Claims, 10 Drawing Sheets

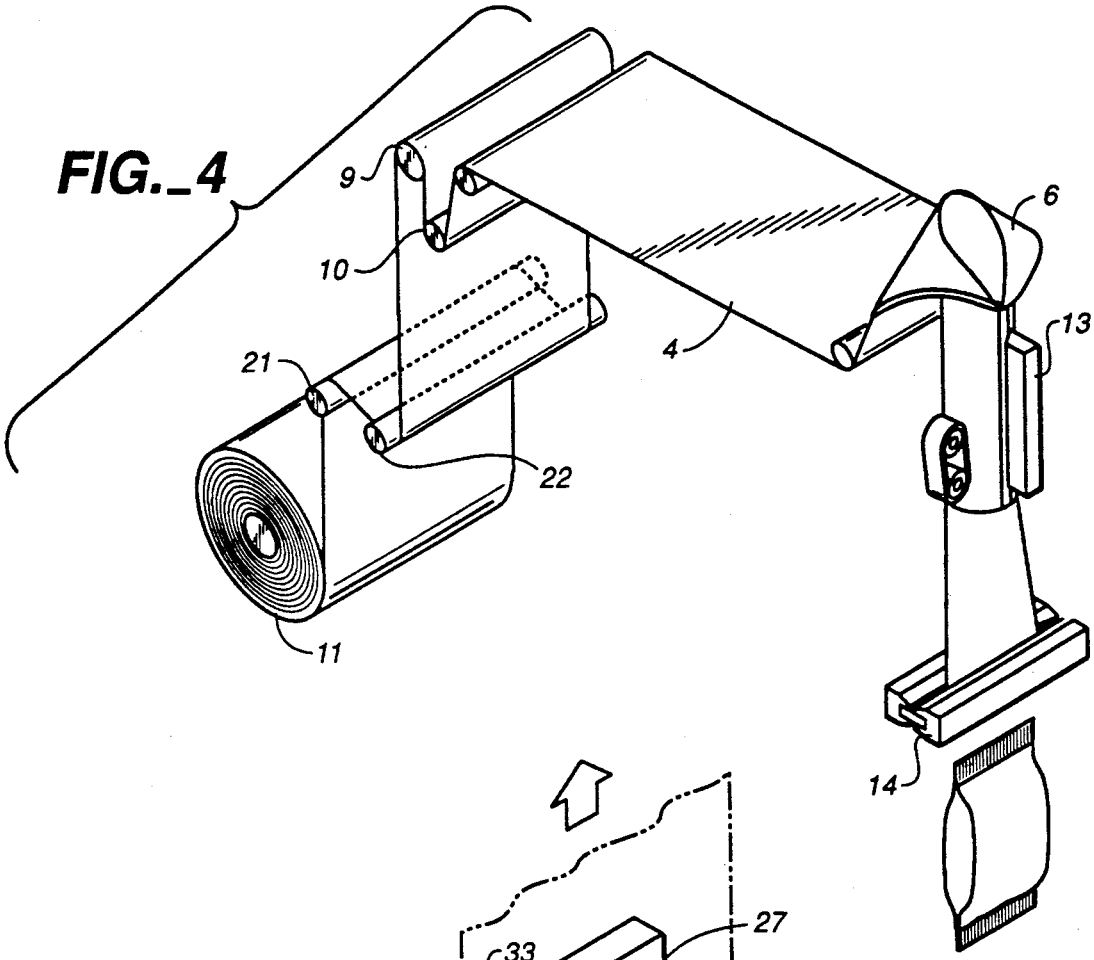
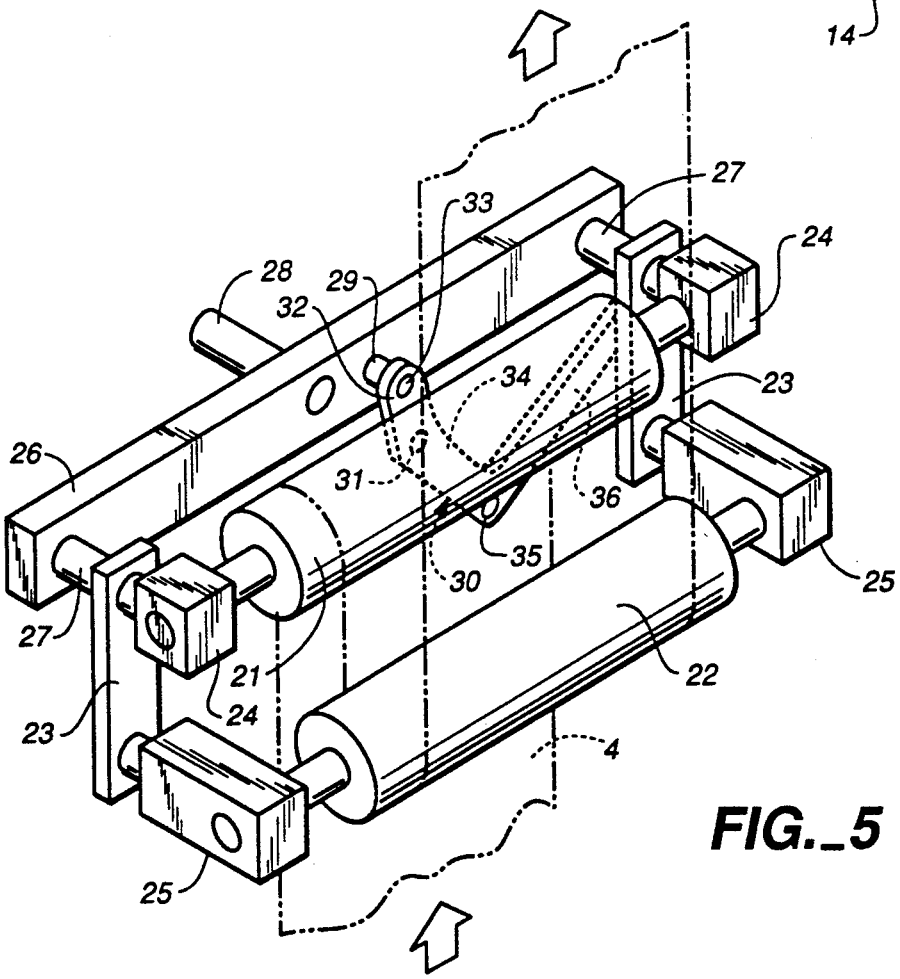
FIG._5

FORM-FILL-SEAL TYPE PACKAGING MACHINE

BACKGROUND OF THE INVENTION

This invention relates to packaging machines of the form-fill-seal type and, in particular, to such machines adapted for use in combination with a weigher having two discharge chutes.

Packaging machines of the so-called form-fill-seal type have been known as efficient means for providing packaged goods because they are able to form bags and to concurrently have them filled with articles to be packaged. As shown in FIG. 1, a typical example of prior art packaging machine 1 of this type has a film roll 11 supported by a film-supporting shaft 3 extending transversely from left to right at the back of its frame 2. A web of belt-like elongated thermoplastic flexible packaging material (hereinafter referred to as "film") 4, from which bags are to be made, is pulled out of this film roll 11, passed through guide rollers 8 and 9 and a dancer roller 10, and brought forward to a former 6 at a front part of the machine 1 where the film is made into a tubular form with its side edges superposed one on top of the other. A vertical sealer 13 seals these superposed side edges thermally to thereby form a film tube 5, and a horizontal sealer 14 seals the film tube 5 horizontally to make a bag. Weighing machines, such as combinational weighers, having two discharge paths have also been known, as disclosed, for example, in U.S. Pat. Nos. 4,399,880, 4,467,880, 4,544,042, 4,558,774, 4,570,727, and 4,676,326 assigned to the present assignee. Where articles to be packaged are weighed by a weigher of this type, two packaging machines 1 must be placed next to each other as shown in FIG. 2 wherein numeral 15 indicates the weigher, numeral 16 indicates its collector chute and numerals 17 indicate its discharge chutes. Articles (of the same kind or of different kinds) discharged individually through these two discharge chutes 17 are supplied to the pair of packaging machines 1 through hoppers 18, which are disposed above and coaxially with their formers 6 as shown in FIG. 1. When a pair of prior art packaging machines 1 is set next to each other as shown in FIG. 2, however, the distance P between their hoppers 18 (that is, the distance between their formers 6) is typically about 800~900 mm. Since the distance p between the bottom openings of the collector chute 16 is generally about 600~650 mm and hence is much smaller than P, the discharge chutes 17 must be tilted as shown in FIG. 2. This causes the discharged articles to take zigzag paths in descending through the hoppers 18 as shown schematically by a series of arrows in FIG. 2. Their flow therefore becomes unstable, and this affects the efficiency of packaging operation adversely. In summary, although the flow of discharged articles can be made smoother by reducing the distance p, the distance (or pitch) P between the formers 6 is controlled by the width of the machines 1 and cannot be reduced beyond a certain limit.

Another problem, which is addressed to by the present invention, relates to the loading of the film roll 11 onto the packaging machine 1. It now goes without saying that it is more advantageous to use a film roll of a larger diameter so as to reduce the frequency at which a new film roll must be loaded because the efficiency of the packaging operation can be thereby improved. Since the weight of a film roll increases proportionally to the square of its diameter, however, larger film rolls are difficult to handle and to set to the film-supporting shaft 3. Although the film roll 11 should be positioned correctly on the shaft 3 such that the center line of the film 4 rolled therefrom will coincide with the center line of the film tube 5, this centering operation is also made difficult if the loading of the film roll 11 itself is difficult.

It should be realized, furthermore, that the film 4 is usually printed only on one side and this printed side should eventually face outward when it is made into a tubular form by the former 6. This means that the film 4, as it is transported horizontally to the top of the former 6, should have its printed side facing downward. When the rear edge of a foregoing web is attached to the front edge of the film from a newly loaded roll 11 (say, by using an adhesive tape) between the guiding rollers 8 and 9, the designs printed on the film 4 cannot be matched easily, and the bag made at such a junction may not be usable commercially.

Still another problem to be solved by the present invention relates to a mechanism for correcting the zigzag motion of the film 4 as it is transported to the former 6. Although not shown in FIG. 1, such a mechanism may be inserted in the path of the web of film 4 and may comprise, as disclosed in Japanese Patent Publications Tokko 37-10058 and Tokko 45-7216, two rollers which are parallel and of which the orientation may be adjusted. With reference to FIG. 3, which shows the principle of operation of such a prior art mechanism, the web of film 4 is first wound halfway around a guide roller 21 of radius r, reversing its direction of travel. After it advances backward by a distance a, it is wound halfway around a tracking roller 22, which is parallel to the guide roller 21 and is also of radius r, to reverse its direction of travel again such that it now advances in the original direction of travel. If the direction of extension of these rollers 21 and 22 is changed by a small angle of $\theta$, the web undergoes a displacement by $(2\pi r+a)\tan\theta$ in the direction of the rollers 21 and 22, or a transverse displacement of $\epsilon=2(\pi r+a)\sin\theta$, as shown in FIG. 3. It is to be noted in this connection that the web, in order to bring about this transverse displacement, slides over the tracking roller 22 by a distance as large as $l=(\pi r+a)\tan\theta$ as shown in FIG. 3. This tends to cause the film 4 to wrinkle because of the difference in the tension in the film 4 on both sides of the web.

SUMMARY OF THE INVENTION

It is therefore an object of the present invention to provide form-fill-seal packaging machines which are so designed that two of them can be placed next to each other with the separation between their formers reduced as much as possible from the width of the machines themselves such that articles dropped from a weigher having two discharge chutes can smoothly flow into the bags being formed.

It is another object of the present invention to provide a form-fill-seal packaging machine with which the web of film pulled out of a film roll can be easily centered with respect to the film tube formed by its former.

It is still another object of the present invention to provide such a packaging machine onto which even a large film roll can be loaded easily by a simple operation such that the film rolls need not be exchanged frequently and hence the efficiency of operation of the machine is improved.

It is still another object of the present invention to provide such a packaging machine with which the rear end of the film from a foregoing film roll can be easily joined with the front edge of the film from a newly loaded film roll such that their printed designs match at the joint.

To attain one or more of the aforementioned objects, a packaging machine according to the present invention may be characterized as having a mechanism with two parallel rollers inserted in the path of travel of its film such that the path can be shifted transversely. For this purpose, not only are these rollers formed as two sides of a linked parallelogram unit, but also the shape of the parallelogram is made automatically changeable according to the direction of the rollers with respect to the travel path of the film. This has the effect of reducing the transverse distance by which the film will have to slide on one of the rollers and hence of preventing the film from wrinkling as its travel path is transversely shifted.

A packaging machine according to another embodiment of the invention may be characterized as having a film-supporting shaft extending towards the back of its frame (and not in the transverse direction as in the prior art packaging machine described above). A film roll loaded to the film-supporting shaft, therefore, assumes the forward-backward direction, and the web of film is pulled upward from the film roll. In order to change the direction of travel of the film by 90 degrees towards the former which is at a front part of the machine, there is provided above the film roll a horizontal roller which is oriented diagonally. This diagonal roller is movable adjustably in the forward-backward direction, depending on the width of the film being used such that its center line is accurately directed to the former.

BRIEF DESCRIPTION OF THE DRAWINGS

FIG. 4 is a schematic of the film-transporting components of a packaging machine according to a first embodiment of the present invention;

FIG. 5 is a perspective view of a portion of FIG. 4 showing the connection of the guide and tracking rollers more in detail;

DETAILED DESCRIPTION OF THE INVENTION

In what follows, the present invention will be described by way of examples, but these examples are to be interpreted as being illustrative of the invention and not as limiting its scope. For convenience, the parts of these exemplary machines to be described and illustrated, which are substantially the same as the corresponding parts in the prior art machine explained above, are designated by the same numerals and will not be repetitiously described.

Figure 6:
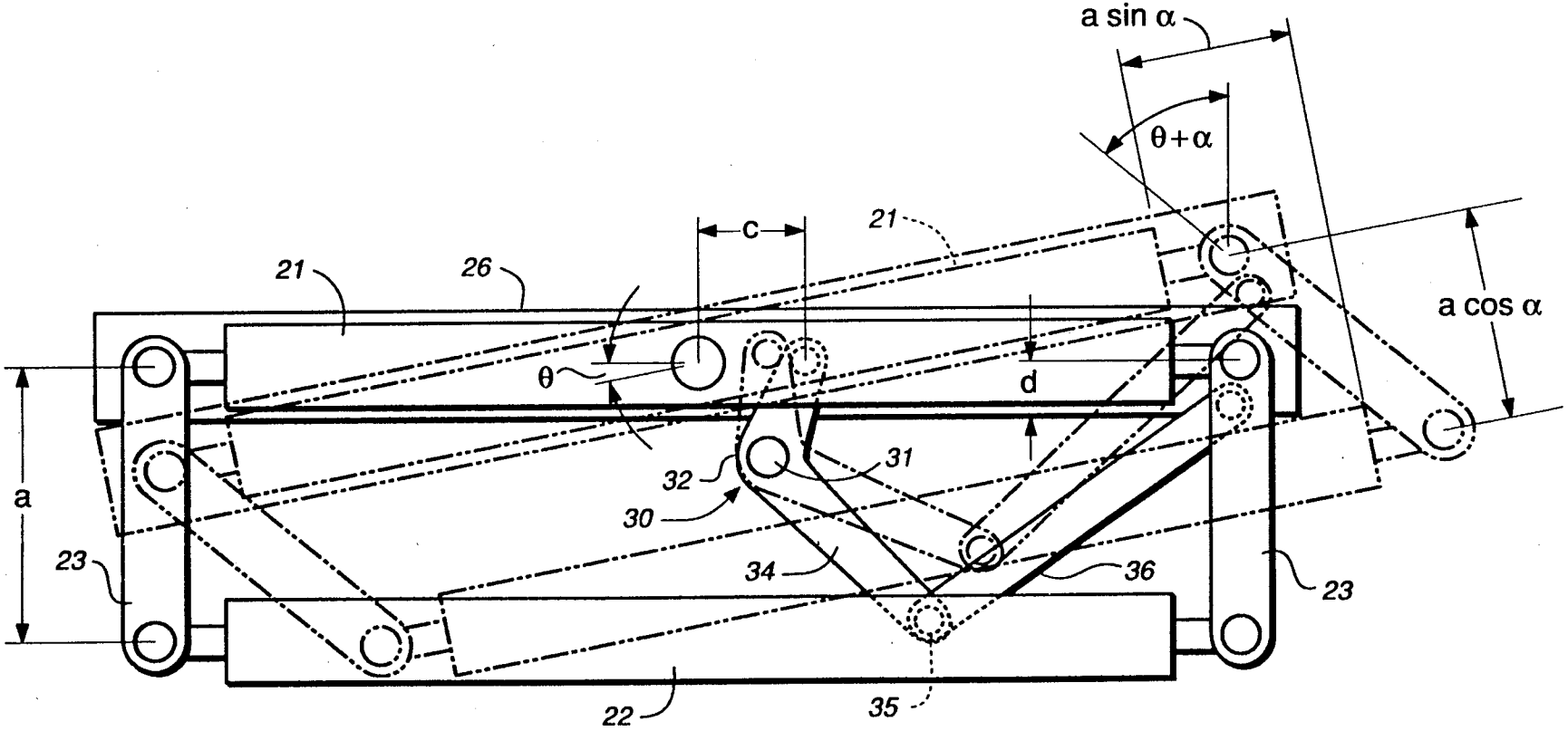
FIG. 6 is a front view of the parts shown in FIG. 5 to show their functions.

FIGS. 4–6 relate to a form-fill-seal packaging machine according to a first embodiment of the present invention. For convenience, FIG. 4 shows only its film-transporting components, characterized as including a pair of mutually parallel rollers (the guide and tracking rollers 21 and 22), FIG. 5 showing the connection between these rollers 21 and 22 in detail.

As shown in FIG. 5, the guide roller 21 and the tracking roller 22 are each supported rotatably by a pair of bearings 24 and 25, respectively, which are, in turn, rotatably supported by a pair of connecting pieces 23 such that these two rollers 21 and 22 and the pair of connecting pieces 23 together form a linked parallelogram unit. Numeral 26 indicates an elongated supporting member for changing the orientation of this parallelogram unit. The supporting member 26 extends parallel to the rollers 21 and 2 and rotatably supports the two connecting pieces 23 by a pair of axes 27 at its end positions. At its center, the supporting member 26 is attached to a rotary shaft 28, through which it is connected to a rotary power means (not shown) supported by a bracket attached to the frame 2.

Numeral 30 indicates a lever of a bell crank type having a shorter arm 32 and a longer arm 34 and being supported rotatably by the frame 2 through an axis 31. This lever 30 is for the purpose of changing the position of the tracking roller 22 relative to the guide roller 21, as will be explained below, and the end of its shorter arm 32 is connected through a pin 33 to an elongated hole 29 near the center of the supporting member 26. Similarly, the end of the longer arm 34 of the lever 30 is axially connected through another pin 35 to one end of a linking member 36, the other end of this linking member 36 being connected to one of the connecting pieces 23 near the axis supporting the bearing 24.

With the guide and tracking rollers 21 and 22 thus connected, if the supporting member 26 is rotated around the shaft 28 by $\theta$ when these rollers 21 and 22 and their connecting pieces 23 form a rectangle as shown by solid lines in FIG. 6, these rollers 21 and 23 and the connecting pieces 23 come to assume positions as depicted by broken lines in FIG. 6, that is, the guide roller 21 will change its direction of extension by $\theta$, and so will the tracking roller 22, but the connecting pieces 23 will rotate by an extra angle of $\alpha$, or by a total angle of $(\theta+\alpha)$, because of the connection to the supporting member 26 through the bell crank lever 30. Thus, the originally rectangular shape of the linked unit composed of the guide roller 21, the tracking roller 22 and the connecting pieces 23 is now a parallelogram, the tracking roller 22 shifting transversely with respect to the guide roller 21 by a distance of $a\sin\alpha$.

Figure 3:
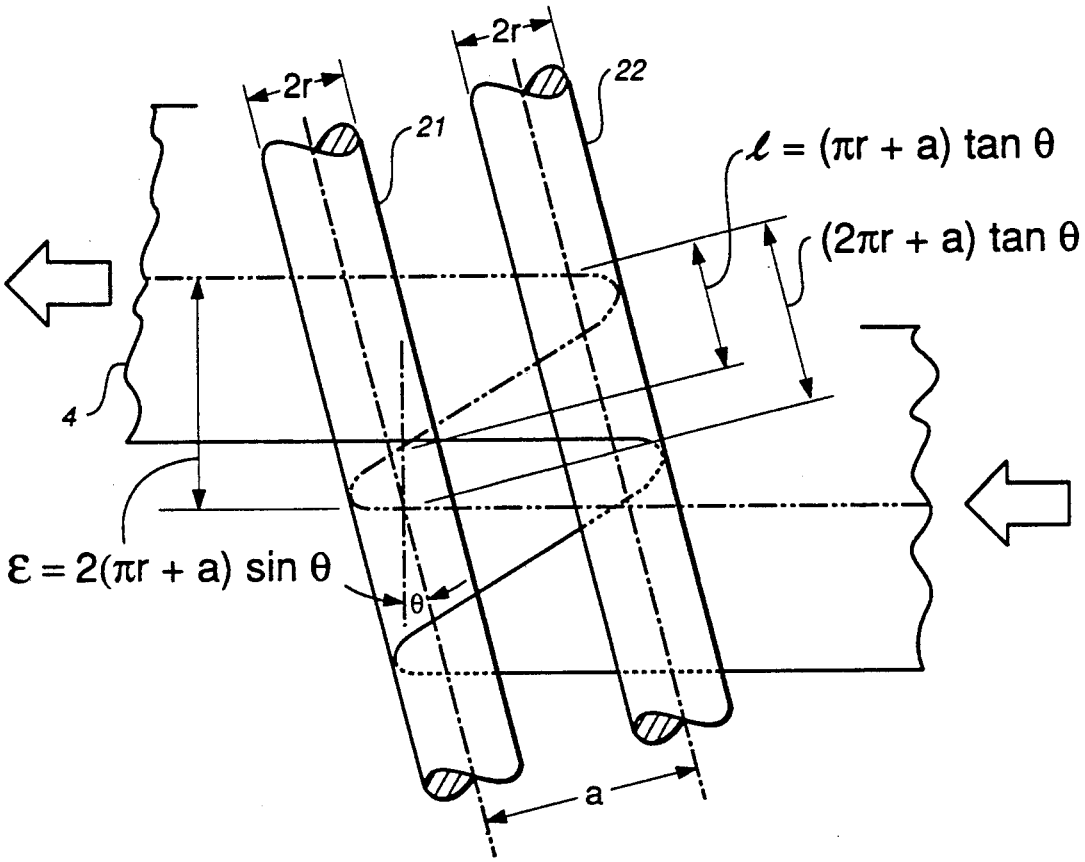
FIG. 3 (PRIOR ART)
FIG. 3 is an explanatory drawing for showing the basic principle of alignment adjustment of a web by a prior art mechanism having two parallel rollers.

According to the present invention, the lengths of the sides of this parallelogram, the distance c between the shaft 28 at the center of the supporting member 26 and the pin 33, and the distance d between the junctions of the connecting piece 23 with the supporting member 26 and the linking member 36 (the distances c and d being shown in FIG. 6) are so determined that $a\sin\alpha=(\pi r+a)\tan\theta$. Thus, as the supporting member 26 is rotated so as to transversely shift the path of the film 4 by $\epsilon=2(\pi r+a)\sin\theta$ as explained above, there will be substantially no transverse displacement of the film 4 relative to the tracking roller 22 because the tracking roller 22 is moved by an extra distance of l (as defined above with reference to FIG. 3). As the orientation of the guide and tracking rollers 21 and 22 is thus changed, the total distance of travel by the film will be increased (or decreased), changing the tension in the film. Since the separation between these rollers 21 and 22 is also changed according to the present invention, however, the change in the tension can be somewhat reduced.

Figure 7:
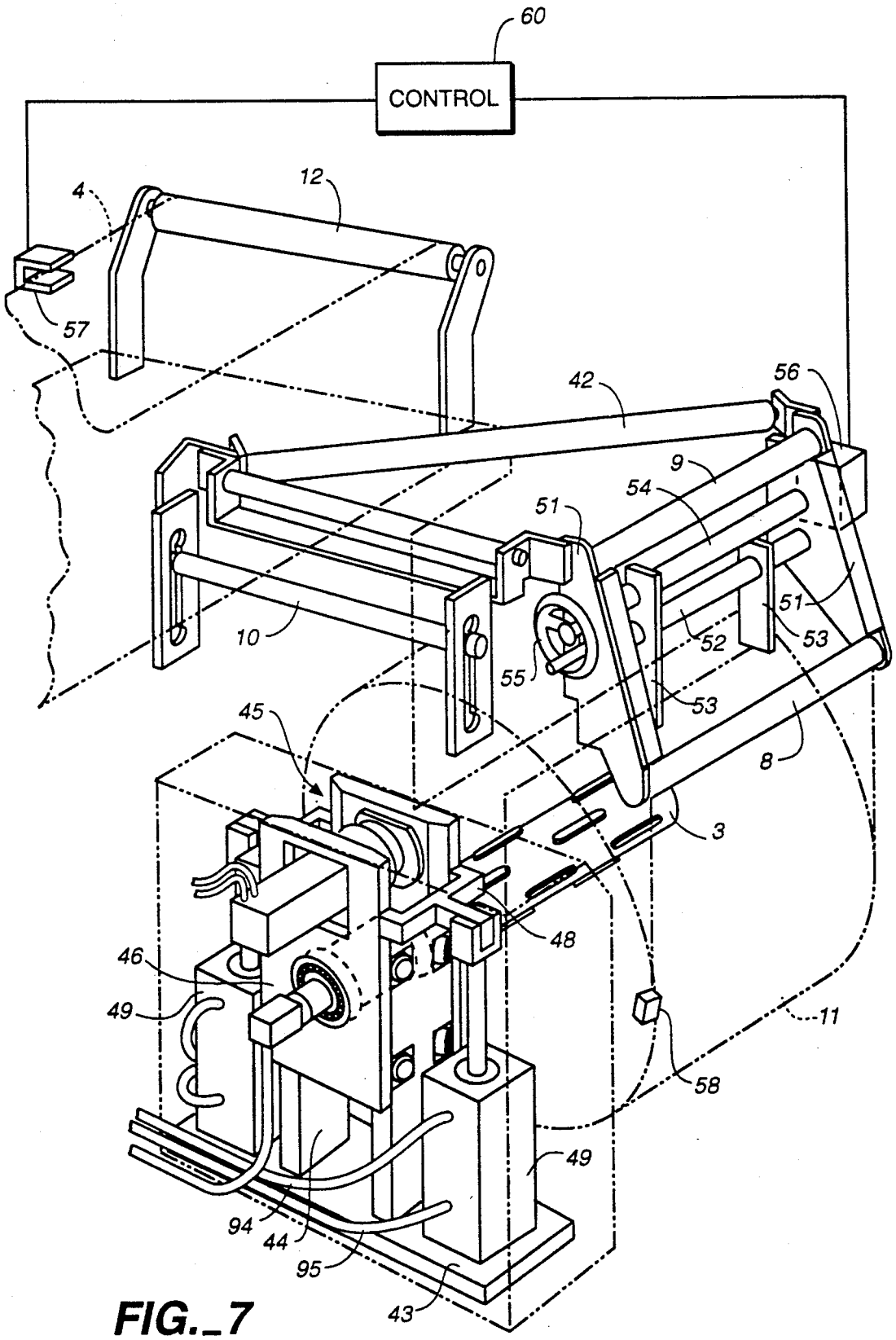
FIG. 7 is a diagonal view of a portion of another packaging machine embodying the present invention, principally showing its film-supporting shaft and film-transporting components.

Next, a form-fill-seal packaging machine of a different design according to a second embodiment of the invention is explained with reference to FIG. 7.

As will be explained more in detail below, the film roll 11 is mounted onto a cantilever film-supporting shaft 3 which extends towards the back of the machine. For guiding the film 4 pulled out of the film roll 11 towards the former (shown at 6 in FIG. 6 and situated at a front part of the machine), there is provided, in addition to guide rollers 8, 9 and 12 and a dancer roller 10, a diagonal rod 42 disposed horizontally and making an angle of about 45 degrees to the forward-backward direction.

Figure 8:
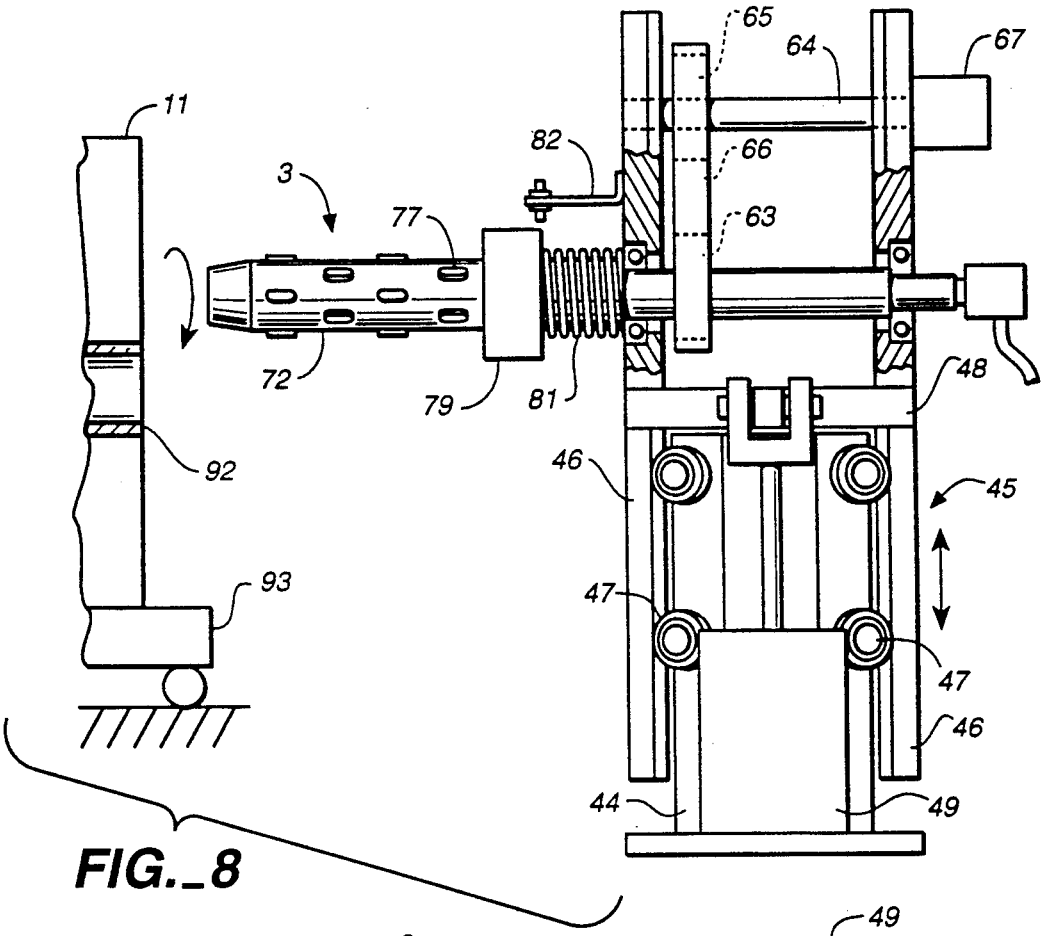
FIG. 8 is a partially sectional vertical view of the film roll holder shown in FIG. 7 when it is not loaded.
Figure 10:
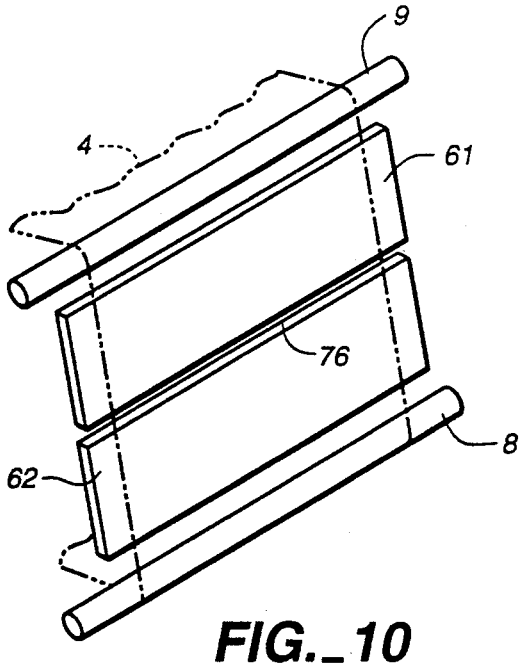
FIG. 10 is a diagonal view of the electrostatic plates between the guide rollers shown in FIG. 7.
Figure 9:
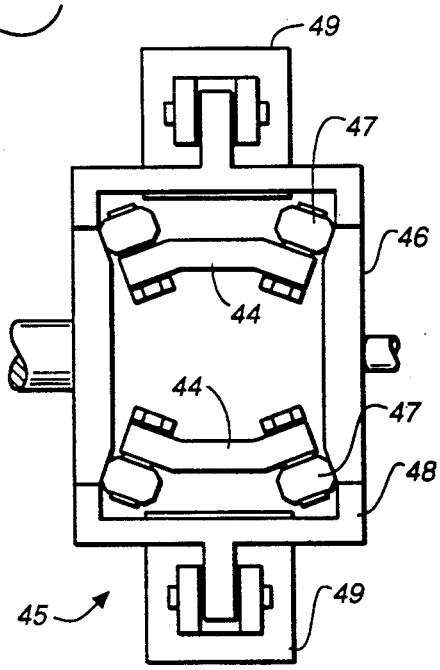
FIG. 9 is a plan view of a part of the film roll holder of FIG. 8.

With reference concurrently also to FIGS. 8 and 9, the film roll holder 45 is comprised not only of the film-supporting shaft 3, but also of a pair of fixed frames 44 affixed to a base plate 43 and a pair of movable frames 46 which are connected to each other by connecting arms 48 and are disposed perpendicularly to the fixed frames 44. Rollers 47 are provided on both side surfaces of the fixed frames 44 so as to contact inner side surfaces of the movable frames 46 such that the movable frames 46 can be moved up and down with respect to the fixed frames 44. The film-supporting shaft 3 is horizontally and rotatably supported by these vertically movable frames 46. The connecting arms 48 are attached to the pistons of a pair of working cylinders 49 disposed on opposite sides of the fixed frames 44 on the base plate 43. As shown in FIG. 8, a drive shaft 64 is axially supported between the movable frames 46 parallel to and above the film-supporting shaft 3. Pulleys 63 and 65 are respectively attached to the film-supporting shaft 3 and to this drive shaft 64. A belt 66 is stretched between these pulleys 63 and 65 to establish a motion-communicating relationship therebetween. The drive shaft 64 is operated by a motor 67 attached to one of the movable frames 46. Although not shown in FIG. 7 for clarity, there is provided between the guide rollers 8 and 9 a pair of mutually adjacent (upper and lower) electrostatic plates 61 and 62 with a groove 76 formed therebetween.

Figure 1:
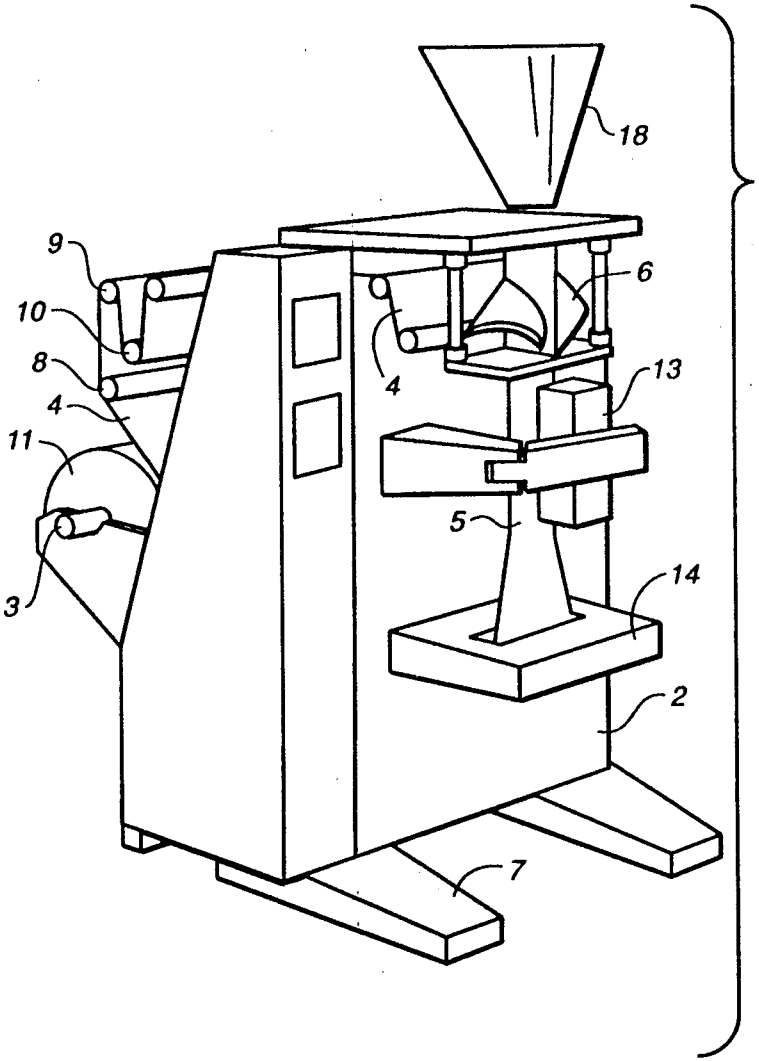
FIG. 1 (PRIOR ART)
FIG. 1 is a perspective view of a prior art packaging machine of the form-fill-seal type.

The diagonal rod 42, like the guide rollers 8 and 9, is supported horizontally between a pair of side frames 51 which are connected to each other by a horizontally supported guide rod 52 and movable in the forward-backward direction. The guide rod 52 extends in the forward-backward direction and slidably penetrates a pair of brackets 53 fastened to the frame (shown at 2 in FIG. 1). A screw bar 54, engaging with the brackets 53 and being rotatably supported near both its ends by the side frames 51, is disposed parallel to and above the guide rod 52. A manually operable handle 55 is attached to one of its ends protruding out of one of the side frames 51, and the other of its ends is attached to a motor 56. Numeral 57 indicates an edge sensor for detecting the edge of the web of film 4 as it is transported towards the former (shown at 6 in FIGS. 1 and 4). Numeral 60 symbolically indicates a control device connected to the edge sensor 57 to receive a detection signal therefrom and to thereby control the operation of the motor 56. Numeral 58 indicates an eye mark detector for detecting eye marks which may be provided along a side edge of the film 4.

Figure 11:
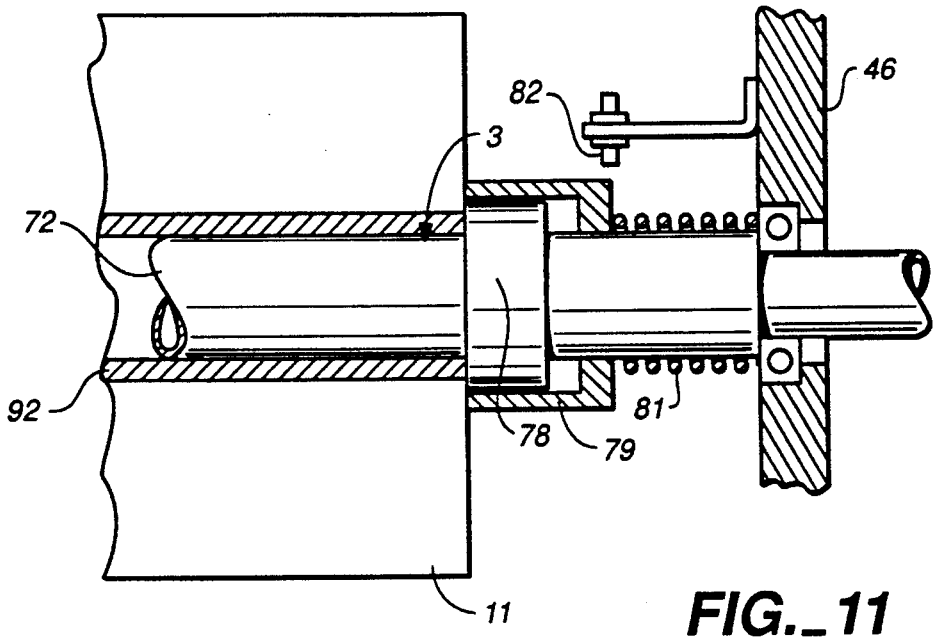
FIG. 11 is a partially sectional vertical view of the film-supporting shaft when it is loaded.
Figure 12:
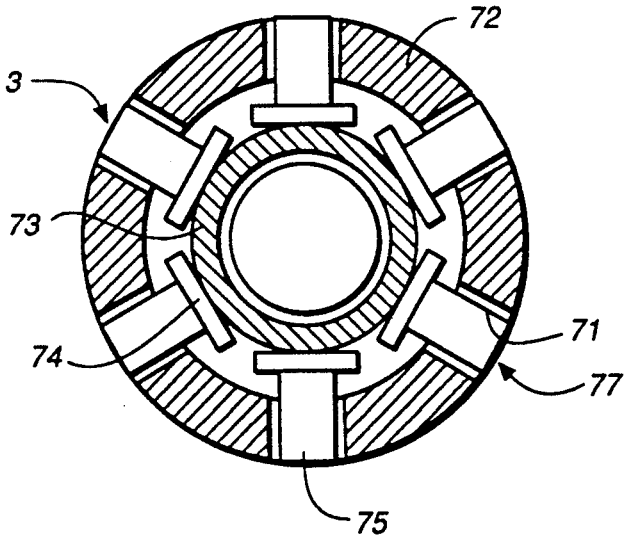
FIG. 12 is a vertical sectional view of the film-supporting shaft when it is not loaded.
Figure 13:
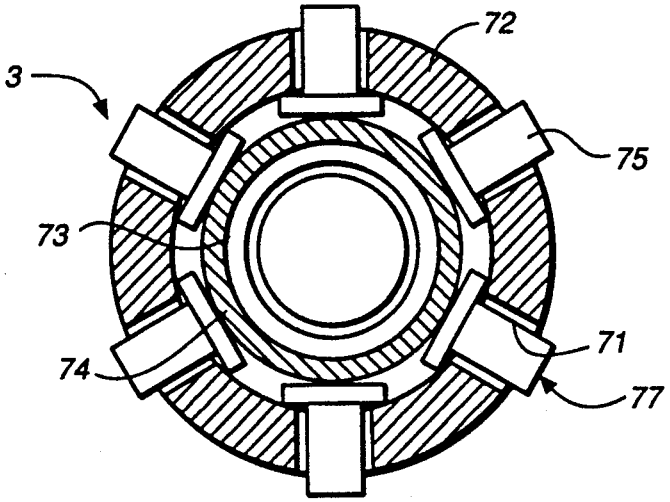
FIG. 13 is a vertical sectional view of the film-supporting shaft when it is loaded.

As shown in FIGS. 11, 12 and 13, the film-supporting shaft 3 is comprised of what is commonly called an air shaft, having an tubular outer cylinder 72 with a plurality of throughholes 71 on its outer wall. Inside this outer cylinder 72 is an inner cylinder 73 which expands if a fluid pressure is applied from inside and contracts if this liquid pressure is removed. The throughholes 71 are provided with gripping members 77 with their enlarged heads 74 contacting the outer surface of the inner cylinder 73 and with their leg parts 75 slidably engaging the throughholes 71. A flange 78 is provided at the end of the outer cylinder 72 on the side proximal to the movable frames 46. Numeral 79 in FIGS. 8 and 11 indicates a sleeve which engagingly covers the flange 78. A spring 81 is provided between the sleeve 79 and the movable frame 46 such that its biasing force keeps the sleeve 79 pressed against the film roll 11. Numeral 82 indicates a proximity switch disposed above the sleeve 79. This may be, for example, of a known type containing a search coil for generating an eddy current when a metallic body is detected in its proximity.

Figure 14:
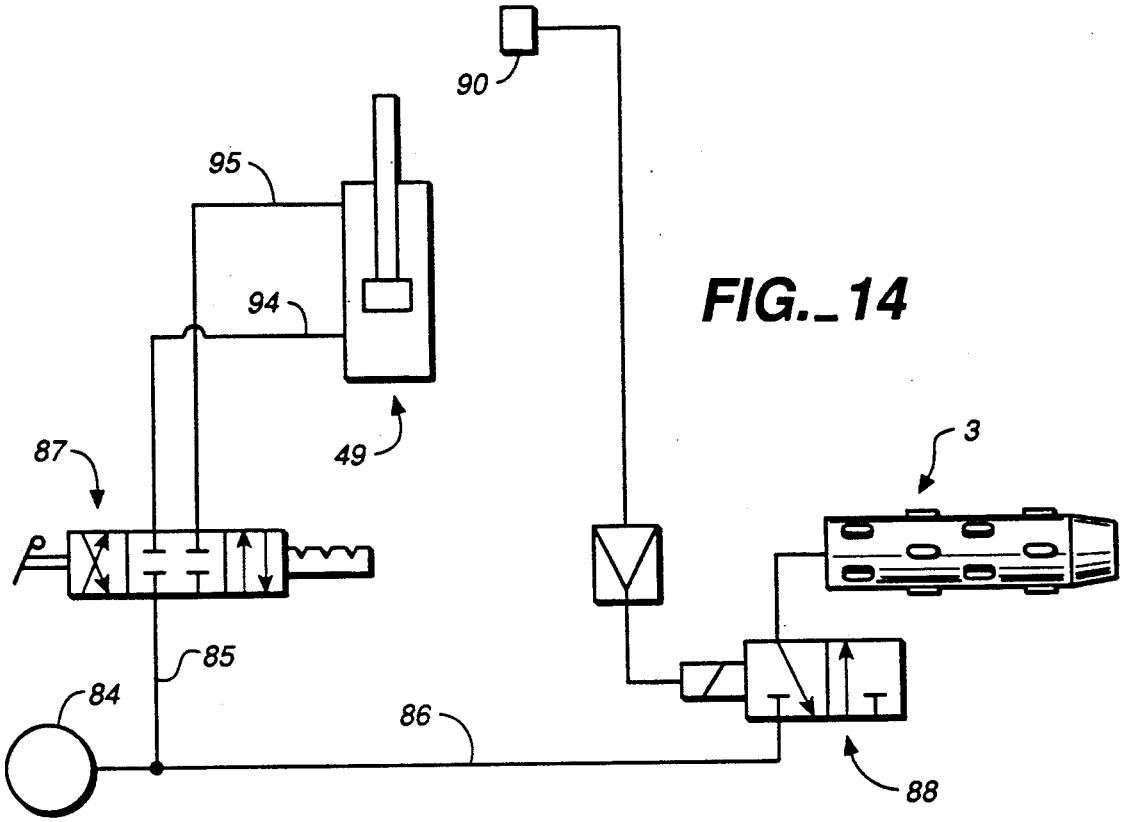
FIG. 14 is a fluid circuit diagram for the packaging machine of FIG. 7.

The film-supporting shaft 3 and the working cylinders 49 are connected to a fluid circuit as shown in FIG. 14 through which a pressurized liquid is circulated. The liquid is supplied from a liquid source (not shown) by a pump 84 into two liquid paths 85 and 86. The first path 85 is provided with a (first) switch valve 87 which is operable manually and is connected through pipes 94 and 95 to parts of the working cylinder 49 above and below its piston. A detector switch 90 is provided for outputting a signal when the piston of the working cylinder 49 is detected at a preset standard position. The second path 86 is provided with another (second) switch valve 88 adapted to operate in response to a signal outputted from the detector switch 90 so as to control the flow of the liquid into and out of the interior of the film-supporting shaft 3, as will be explained below.

At the time of installing a film roll 11 onto the film-supporting shaft 3, the film roll 11, which is usually very heavy, is transported to its vicinity on a wagon 93 as shown in FIG. 8 such that its core cylinder 92 is parallel to and in the same vertical plane as the film-supporting shaft 3. If the core cylinder 92 of the film roll 11 is lower than the film-supporting shaft 3, the first switch valve 87 is manually operated such that the liquid is supplied into the upper part of the working cylinder 49 and discharged from its lower part. The film-supporting shaft 3 is thereby lowered until it is in coaxial relationship with the core cylinder 92 of the film roll 11. After the operation of the first switch valve 87 is interrupted and the downward motion of the shaft 3 is stopped, the film roll 11 is loaded by sliding it engagingly along the shaft 3 until its front end hits the flange 78. While the film roll 11 is thus being loaded to the film-supporting shaft 3, the gripping members 77 inside the shaft 3 are in their retracted positions as shown in FIG. 12 so as not to interfere with the sliding motion of the film roll 11 along the outer surface of the shaft 3. As the sleeve 79 is compressed by the advancing core cylinder 92 of the film roll 11 against the biasing force of the spring 81 and comes to assume the position shown in FIG. 11, this compressed position of the sleeve 79 is detected by the proximity switch 82, indicating the normal loaded position of the film roll 11 on the film-supporting shaft 3 in its axial direction. The first switch valve 87 is thereafter operated manually in reverse to move the pistons of the working cylinders 49 in the opposite direction and to thereby raise the film-supporting shaft 3 upward. When the film-supporting shaft 3 reaches a predetermined standard height and thereby activates the detector switch 90, the second switch valve 88 is switched and causes the liquid to flow into the film-supporting shaft 3, thereby causing its inner cylinder 73 to expand. The gripping members 77 are thereby pushed outward and grip the core cylinder 92 of the film roll 11 from inside. When the central axis of the core cylinder 92 is higher than the film-supporting shaft 3 when the film roller 11 is initially brought to the machine, the film-supporting shaft 3 is lowered by operating the first switch valve 87 in the opposite direction.

Figure 15:
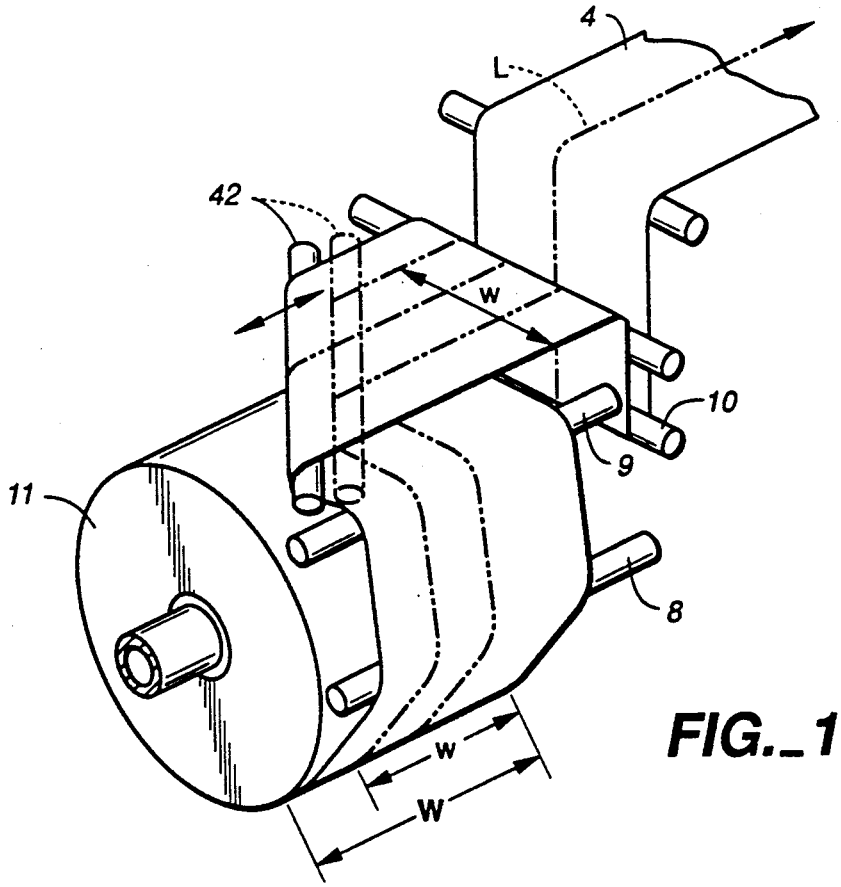
FIG. 15 is a schematic diagonal view of a portion of the packaging machine of FIG. 7 for showing the operation for adjusting the center line of the traveling web of film.

After the film roll 11 is thus loaded to the film-supporting shaft 3, the motor 67 is activated to rotate the shaft 3 through the pulleys 63 and 65 and the belt 66. As the film 4 is pulled out of the rotating film roll 11 and is moved upward as shown in FIG. 15, its printed side is facing outside such that its back surface will be outside (facing upward) after it is turned around by the diagonal rod 42 to change its direction of motion by 90 degrees.

As explained above with reference to FIG. 7, the diagonal rod 42 is supported so as to be movable in the forward-backward direction. With reference to FIG. 15, let us assume that the center line of a film of width W (pulled out of a wide film roll of width W) will head directly to the former 6 after it is turned over by the diagonal rod 42 if the diagonal rod 42 is at the position shown by solid lines. If a less wide film roll of width w is mounted then and a narrower film (of width w) is pulled out of it and turned over by the diagonal rod 42 at the position shown by solid lines in FIG. 15, its center line will not head directly to the former 6. In such a situation, the diagonal rod 42 is moved backward within the same horizontal plane to a new position indicated by chain lines in FIG. 15 either by manually operating the handle 55 or by activating the motor 56. If the adjusting horizontal motion of the diagonal rod 42 causes the film 4 to move in a zigzag towards the former 6, this is detected by the edge sensor 57 and a warning signal is outputted. The motor 56 for the screw bar 54 is adapted to be controlled by such a signal outputted from the edge sensor 57 such that the zigzag motion of the film 4 can be corrected. A tension sensor (not shown) is also provided for monitoring the tension in the film 4 as it is transported to the former 6. If the detected tension exceeds a certain critical value, the motor 67 for rotating the shaft 3 is controlled such that a constant amount of the film 4 will be pulled out.

After the film 4 is pulled out of the film roll 11, it is formed into a cylindrical shape by the former 6 and the side edges of the tubular film are sealed together by the vertical sealer 13 to form a film tube 5. The horizontal sealer 14 seals at the top and at the bottom to make a bag in a known manner. Since the film roller 11 is positioned with respect to the flange 78 independently of its size, that is, since the film roller 11 is loaded by pushing it along the film-supporting shaft 3 until the side surface of the film roll holder 45 contacts the flange 78, there is no longer the need to change the position of the eye mark detector 58 according to the size of the film roll 11.

When a film roll 11 is nearly used up and its outer diameter becomes smaller than the inner diameter of the sleeve 79, the sleeve 79 is pushed to the left (with reference to FIG. 11) by the spring 81. When this movement of the sleeve 79 is detected by the switch 82, an alarm (not shown) is sounded to warn the operator. The operator thereupon stops the machine and joins the rear edge of the film from the nearly finished roll with the front edge of another film from a new roll. This is done by first causing the rear edge part of the foregoing film to be pulled by the upper electrostatic plate 61 and simultaneously operating a cutter (not shown) along the groove 76 to cut off the incomplete part at the end. Next, the incomplete part at the front end from the new film is similarly held by the lower electrostatic plate 62 and cut off by the cutter. Thereafter, the two edge parts are joined together by an adhesive tape. This job is made easier because, as explained above, the films have their printed sides facing outside between the guide rollers 8 and 9.

Figure 2:
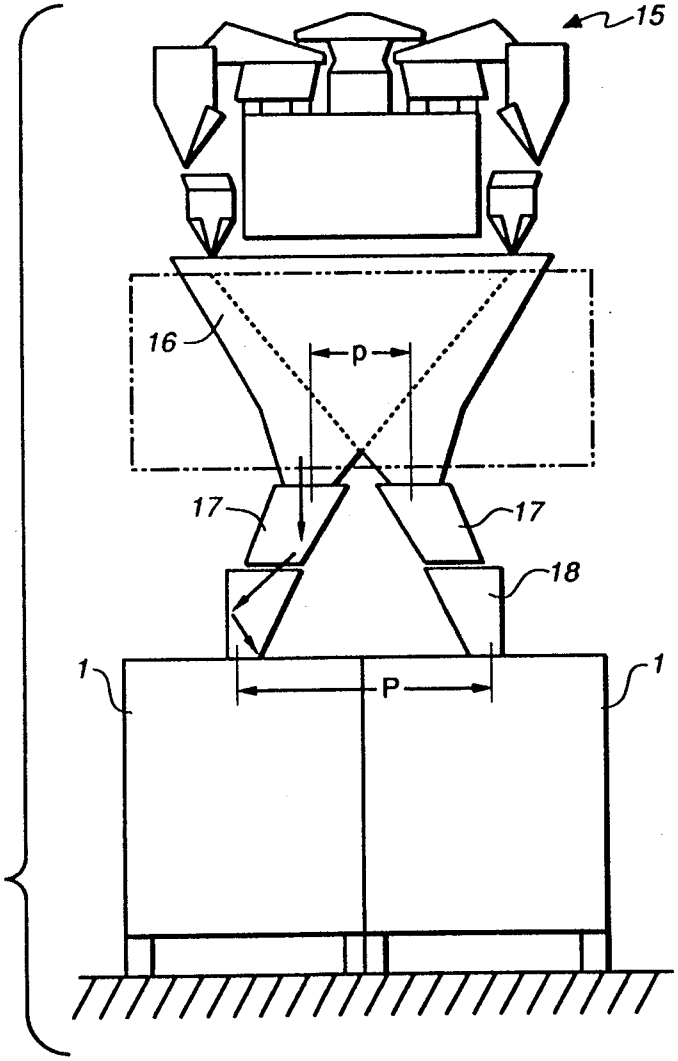
FIG. 2 (PRIOR ART)
FIG. 2 is a schematic of the use of two prior art packaging machines of the type shown in FIG. 1 in combination with a weigher having two discharge chutes.
Figure 17:
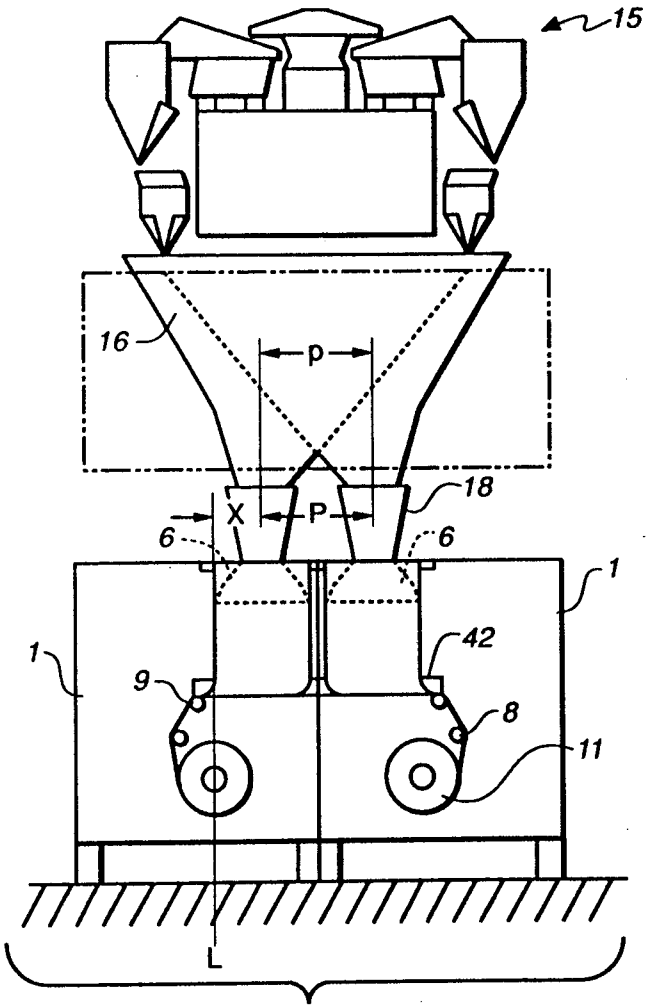
FIG. 17 is a horizontal schematic view of two of the packaging machines of the type shown in FIGS. 7 and 15 being used in combination with a weigher having two discharge chutes.
Figure 16:
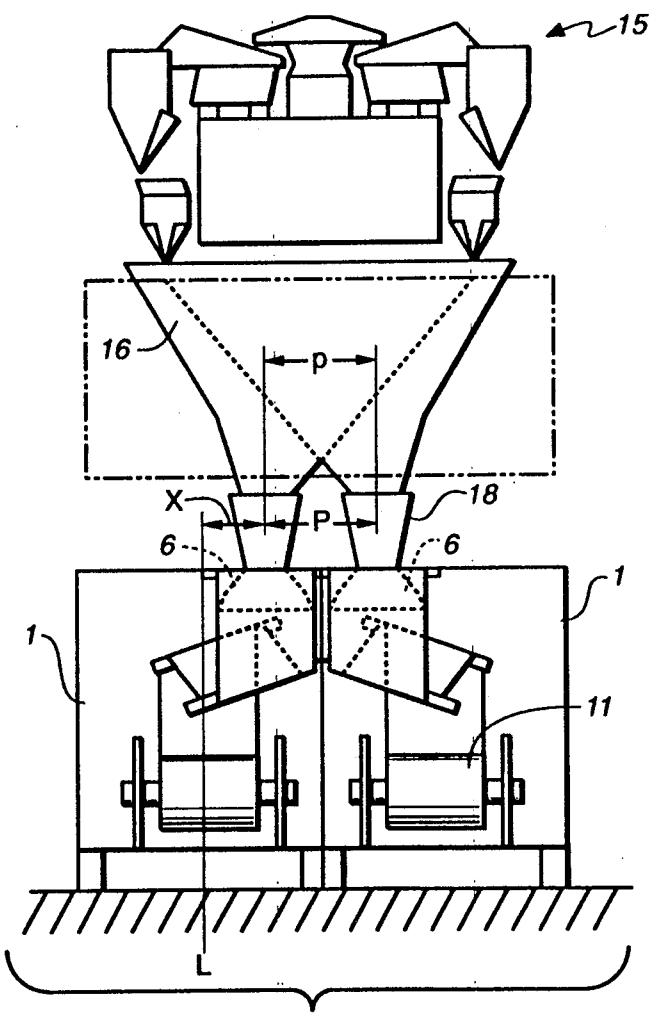
FIG. 16 is a horizontal schematic view of two of the packaging machines of the type shown in FIGS. 4–6 being used in combination with a weigher having two discharge chutes.

FIGS. 16 and 17 are to be contrasted with FIG. 2 and show how two of the packaging machines of the present invention can be used in combination with a weigher having two discharge chutes. FIG. 16 shows the use of two machines of the type according to the first embodiment of the invention explained above by way of FIGS. 4–6, built in a plane-symmetric manner with respect to their side surfaces closer to their formers. FIG. 17 shows the use of two machines of the type according to the second embodiment of the invention explained above by way of FIGS. 7 and 15, built similarly in a plane-symmetric manner with respect to each other. Both FIGS. 16 and 17 show that the formers 6 of two packaging machines 1 according to the present invention can be placed closer together (or p=p by using the symbols defined in FIG. 2) although the centers of the two machines 1 are separated by a larger distance. This is accomplished, according to the first embodiment of the invention, by providing each machine with a pair of diagonally oriented, mutually parallel rollers (21 and 22) to transversely shift the travel path of the film by X from its center line L. According to the second embodiment of the invention, this is accomplished by providing each machine with a diagonal rod 42 to change the direction of travel of the film 4 by 90 degrees. If the width W of the film is greater than the distance p between the discharge chutes, the distance P will have to be increased somewhat. Even in such a situation, however, the separation P can still be made significantly smaller than the distance between the center lines of the two machines.

Figure 18:
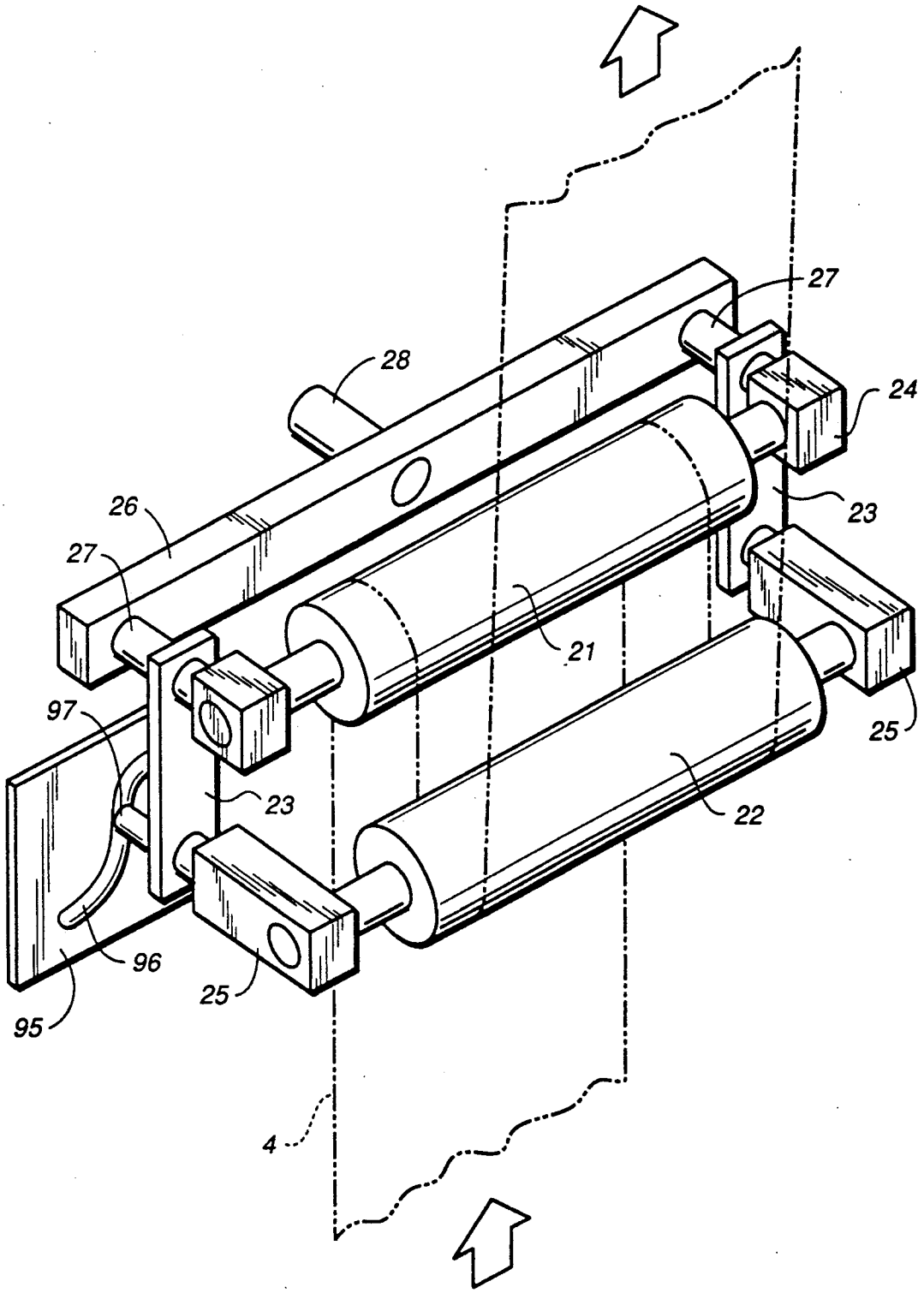
FIG. 18 is a perspective view of another mechanism according to the present invention for controlling the relative motion of the tracking roller with respect to the guide roller.

The present invention has been described above by way of only two examples. As indicated above, however, many modifications and variations are considered possible on the basis of the disclosure given above and within the scope of the invention. For example, the mechanism shown in FIG. 5 for connecting the guide roller 21 and the tracking roller 22 may be replaced by another mechanism shown in FIG. 18 with a guide plate 95 attached to the frame 2 of the machine and having a guiding groove 96 formed therein. A pin 97, which protrudes from one of the connecting pieces 23, is adapted to slide engagingly inside this groove 96 by following its contour. As the supporting member 26 is rotated, the angle of the connecting pieces 23 with respect thereto is thereby controlled. With the guiding groove 96 appropriately designed, it is possible to control the motion of the tracking roller 22 in a desired manner according to the magnitude of $\theta$.

One of the most important advantages attainable by the present invention is that two form-fill-seal type packaging machines can be used in combination with a weigher having two discharge chutes such that the formers of these packaging machines can be substantially directly underneath the openings of these discharge chutes. If this is to be accomplished by transversely shifting the travel paths of the films pulled out of film rolls on the center lines of the packaging machines, the present invention discloses mechanisms whereby this can be accomplished without wrinkling or unduly increasing the tension in the films. If this is to be accomplished by using a diagonal roller to change the direction of the travel path of the film by 90 degrees, an additional advantage is attained whereby the printed side of the film faces outside along a part of its travel path such that an operator can more efficiently join edges of two films by matching their designs.

What is claimed is:

1. A form-fill-seal packaging machine comprising:

supporting means for horizontally supporting a film roll in a transverse direction;

forming means for forming a tubular shape out of a web of elongated flexible film;

transporting means for pulling said web of film out of said film roll and feeding said web to said forming means by guiding said web from said film roll to said forming means along a path;

said forming means being at a transversely off-center position closer to one side of said machine and away from a vertical plane which is perpendicular to said transverse center line and in which lies the longitudinally extending center line of a web of film as said web is pulled out of said film roll; said transporting means including a path-shifting device disposed between said supporting means and said forming means for adjustably shifting said path in said transverse direction; said path-shifting device comprising a pair of rollers which are parallel to each other and oblique to said transverse direction.

2. The packaging machine of claim 1 wherein said path-shifting device further comprises:

a pair of connecting members, said pairs of connecting members and rollers being so rotatably connected to each other as to form a linked variably-shaped parallelogram unit; and rotating means for causing said connecting members to rotate with respect to said pair of rollers to thereby automatically change the shape of said linked parallelogram unit as the orientation of said rollers is changed with respect to said transverse direction.

3. A form-fill-seal packaging machine comprising:

film-supporting means at a back part of said packaging machine for horizontally supporting a film roll;

forming means at a front part of said machine for forming a tubular shape out of a web of elongated flexible material film; and transporting means for pulling said web of film out of said film roll and feeding said web to said forming means by guiding said web from said film roll to said forming means along a path;

said film-supporting means including a film-supporting shaft extending in the front-to-back direction; said transporting means including a diagonal rod which is disposed above said film-supporting shaft and serves to turn said path by approximately 90 degrees.

4. The packaging machine of claim 3 wherein said diagonal rod is supported horizontally and said transporting means further includes means for moving said diagonal rod within a horizontal plane and without changing its direction.

5. The packaging machine of claim 3 wherein said forming means is at a transversely off-center position closer to one side of said machine.

6. The packaging machine of claim 3 further comprising:

a pair of side frames which are connected to each other by a guide rod and supports said diagonal rod;

a rotatable screw bar which is connected to both said side frames and engages with a pair of brackets attached to the frame of said machine, said guide rod slidably penetrating said brackets; and a motor attached to said screw bar for causing said screw bar to rotate.

7. The packaging machine of claim 6 further comprising:

an edge sensor disposed between said diagonal rod and said forming means for detecting the edge position of said web after it passes said diagonal rod; and control means for controlling the operation of said motor according to a detection signal received from said edge sensor.

8. The packaging machine of claim 3 wherein said film-supporting shaft is supported by a vertically movable frame.

9. The packaging machine of claim 3 wherein said film-supporting shaft includes a flange and a sleeve which covers said flange and in which said flange can slide, a spring being provided between said movable frame and said sleeve so as to keep said sleeve pressed against said film roll supported by said film-supporting shaft, a sleeve detector being provided for detecting the position of said sleeve relative to said movable frame.

10. The packaging machine of claim 3 wherein said film-supporting shaft includes gripping members which are adapted to protrude externally by the pressure of a liquid introduced into said film-supporting shaft so as to grip from inside the core cylinder of said film roll.

* * * * *